US007733234B2

(12) United States Patent
Montgomery

(10) Patent No.: US 7,733,234 B2
(45) **Date of Patent: *Jun. 8, 2010**

(54) MICROPROCESSOR OPERATED, PORTABLE EARLY FIRE DETECTION AND PREVENTION DEVICE

(76) Inventor: Tony Chavers Montgomery, 3926 NE. 12th Ave., Portland, OR (US) 97212

( * ) Notice: Subject to any disclaimer, the term of this patent is extended or adjusted under 35 U.S.C. 154(b) by 313 days.

This patent is subject to a terminal disclaimer.

(21) Appl. No.: 11/903,063

(22) Filed: Sep. 19, 2007

(65) Prior Publication Data

US 2008/0012715 A1 Jan. 17, 2008

Related U.S. Application Data

(63) Continuation-in-part of application No. 11/131,094, filed on May 16, 2005, now Pat. No. 7,312,706.

(51) Int. Cl.
*G08B 17/10* (2006.01)

(52) U.S. Cl. ..... 340/628; 340/603; 340/693.5; 340/584

(58) Field of Classification Search ..... 340/603, 340/627, 628, 630, 629, 517, 521–522, 506, 340/511, 584, 577, 578, 693.5–693.6, 588, 340/288–289

See application file for complete search history.

(56) References Cited

U.S. PATENT DOCUMENTS

| | | | | |
|---|---|---|---|---|
| 4,623,878 | A * | 11/1986 | Schoenwetter | 340/628 |
| 5,537,096 | A * | 7/1996 | Wagner | 340/693.6 |
| 5,659,292 | A * | 8/1997 | Tice | 340/522 |
| 6,788,208 | B2 * | 9/2004 | Dittmer | 340/584 |
| 6,791,453 | B1 * | 9/2004 | Andres et al. | 340/286.01 |
| 7,075,646 | B2 * | 7/2006 | Cole | 356/338 |
| 7,312,706 | B1 * | 12/2007 | Montgomery et al. | 340/570 |

* cited by examiner

*Primary Examiner*—Daniel Previl
(74) *Attorney, Agent, or Firm*—Mark S. Hubert

(57) ABSTRACT

The present invention is a battery powered, portable microprocessor based early warning alarming smoke detector. It provides the user two different time limited unattended alarms, as well an alarm for a tipped smoke detector; an alarm for a bumped smoke detector; an alarm based on nearby or lower elevation smoke by either of the two smoke detection devices; and a low power alarm. It offers "full protection" for most of the likely scenarios encountered by residential users that could result in a fire. Since the device is microprocessor controlled, the timing intervals and magnitude of the different alarm notifications can be preprogrammed as well as the sensitivity of the smoke detector devices.

14 Claims, 4 Drawing Sheets

MICROPROCESSOR OPERATED, PORTABLE EARLY FIRE DETECTION AND PREVENTION DEVICE

This application is a continuation-in-part of application claiming benefit under 35 U.S.C. § 121 U.S. non-provisional application Ser. No. 11/131,094 May 16, 2005 now U.S. Pat. No. 7,312,706. The benefit of which is claimed, is considered to be a part of the disclosure of the accompanying application and is hereby incorporated herein its entirety by reference.

BACKGROUND OF THE INVENTION

The present invention relates to a device capable of both preventing and detecting residential fires and more particularly, to a microprocessor based battery powered, portable early fire detection and prevention device.

Cooking fires are one of the leading causes of residential fires and related injuries. Often, to avoid false alarms, most smoke detectors are not recommended for use in the kitchen. The lack of smoke detectors in such close proximity to the oven or range is one of the leading factors in the rapid spread and destruction of kitchen fires. Additionally, cigarette related fires are commonplace and rank as the leading cause of fire deaths for senior citizens and children under eight years old in the United States. It is well documented that many of the cigarette related fires stem from a lit cigarette that is knocked from an ashtray, a lit cigarette that burns unattended and shortens until it tips from the ashtray, or a person who falls asleep while smoking. Although early warning smoke detectors are commonplace in most residences, their proximity to the source of the smoke is directly related to the amount of time available to rectify the situation before it gets out of hand. Furthermore, many smokers prefer to disable their ceiling mounted smoke detectors if they smoke indoors as the hot rising smoke particles continually set off the alarms, and ceiling mounted smoke detectors are difficult to disarm.

The present invention offers true "full protection" for a variety of scenarios, and since it is portable, is easy to disarm. Its portability allows it to be moved to locations of temporary interest, ie a smoking room at a party, a BBQ, an ironing room, a crafts room etc. This is something not likely to be one if one has to get out a ladder to remove the existing smoke detector from a ceiling or stairwell location. Bumping or tilting the device beyond a pre-set angle initiates a continual, audible notification until the situation is remedied. The device also warns the user of a low battery condition. Since the device is microprocessor controlled, the timing intervals and magnitude of the different alarm notifications can be preprogramed as well as the sensitivity of the smoke detectors.

Henceforth, a "full protection" alarming portable early fire detection and prevention device would fulfill a long felt need in the industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a new and improved early warning microprocessor operated, portable early fire detection and prevention device (smoke detector) that will alert the user of potential fire causing scenarios as well as to actual smoke generating situations.

It has many of the advantages mentioned heretofore and many novel features that result in a new microprocessor operated, portable early fire detection and prevention device which is not anticipated, rendered obvious, suggested, or even implied by any of the prior art, either alone or in any combination thereof.

It is a object of this invention to provide an improved microprocessor operated, portable early fire detection and prevention device that automatically gives the user a twp level audible notification if the device has been tipped over or bumped.

It is still a further object of this invention to provide for an improved smoke detector that automatically alarms the user if there is a smoke emitting source near or below the microprocessor operated, portable early fire detection and prevention device.

It is yet a further object of this invention to provide an improved microprocessor operated, portable early fire detection and prevention device that automatically provides the user with a notification of the battery status.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
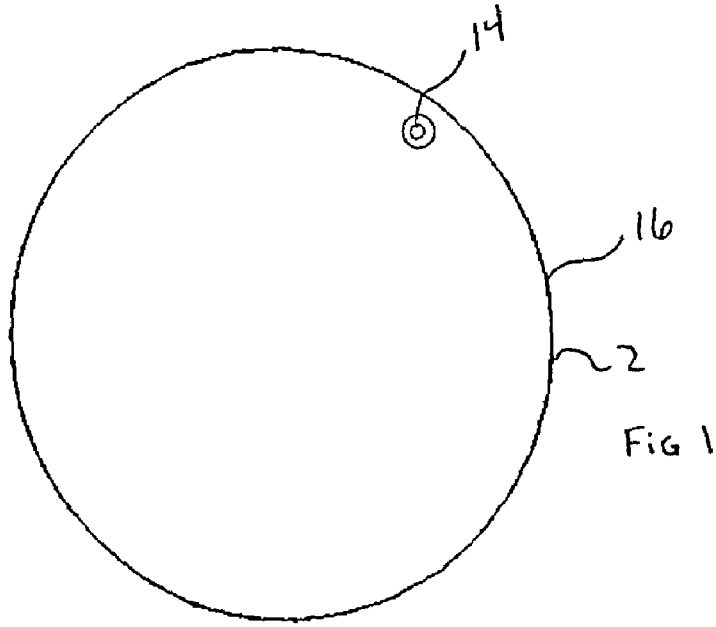
FIG. 1 is a top view of the smoke detector showing the general arrangement of some of the components.
Figure 2:
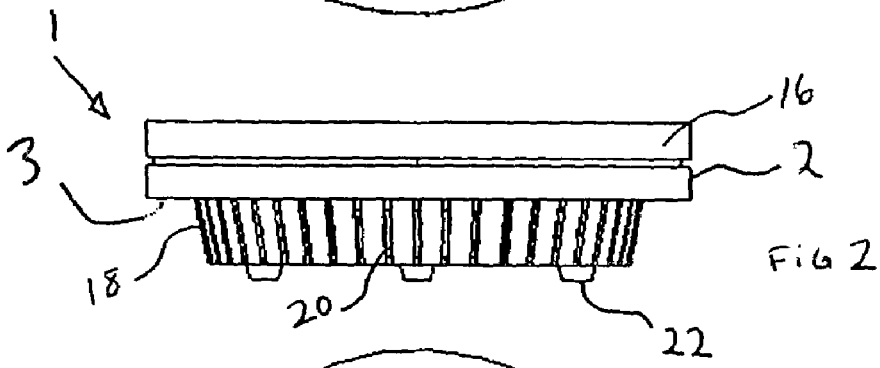
FIG. 2 is a side view of the smoke detector showing it's general configuration.
Figure 3:
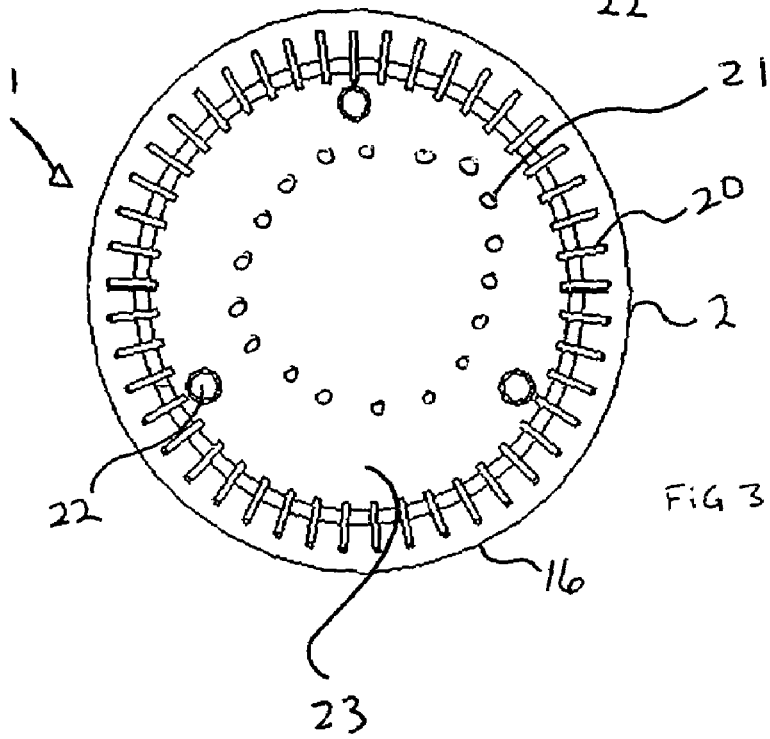
FIG. 3 is a bottom view of the smoke detector showing it's general configuration.

Looking at FIGS. 1, 2, and 3 it can be seen that the smoke detector body 2 is comprised of two matingly engageable polymer parts. There is an upper housing 16 and a vented lower component housing 18. The location of the override optical sensor 14 is visible through the upper housing 16 from a top view. Lower component housing 18 has multiple vents 20 disposed about the circumference to allow the movement of local air and smoke into the vicinity of the smoke detector sensors. The preferred embodiment of smoke detector 1 has feet 22 formed on the base of the lower component housing 18. These may be made of the same material as the rest of the smoke detector body 2 or of a gripable polymer or rubber.

The material of construction for the preferred embodiment is an infra red translucent, heat resistant polycarbonate, although other infra red translucent compounds will suffice, or other heat resistant substrates having regions of infra red translucent material adjacent to the sensors. The entire body 2 need not be made from the same infra red translucent material, as the infra red translucent property is only critical in the area directly above and adjacent to where override optical sensor 14 are located.

Figure 5:
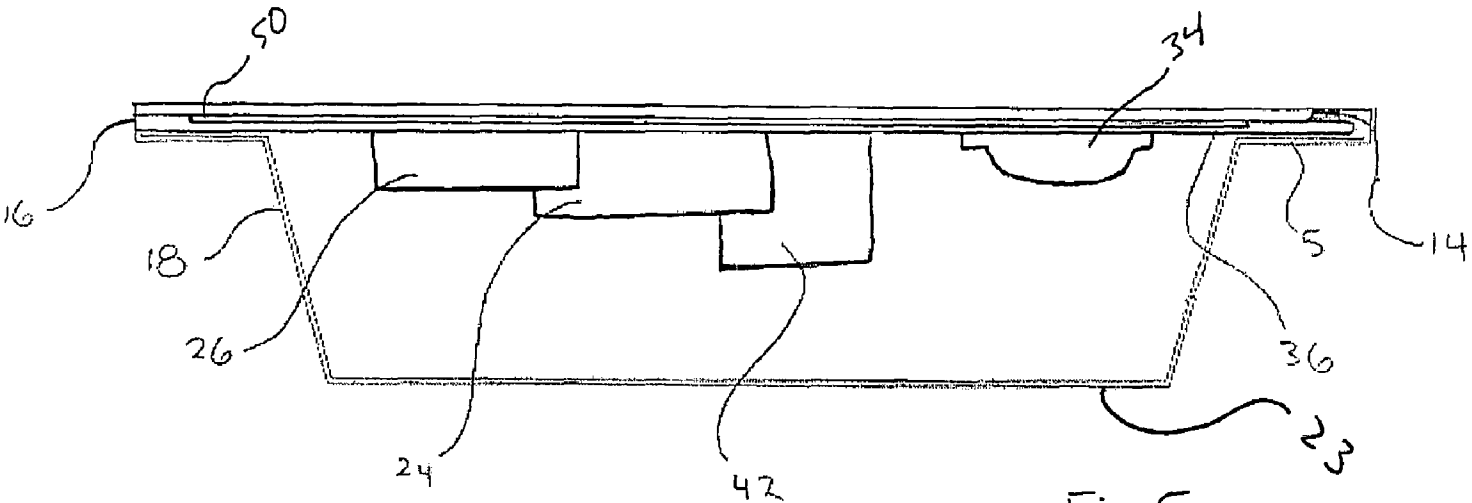
FIG. 5 is a side cross sectional view of the smoke detector showing the general arrangement of the smoke detector's major components.
Figure 6:
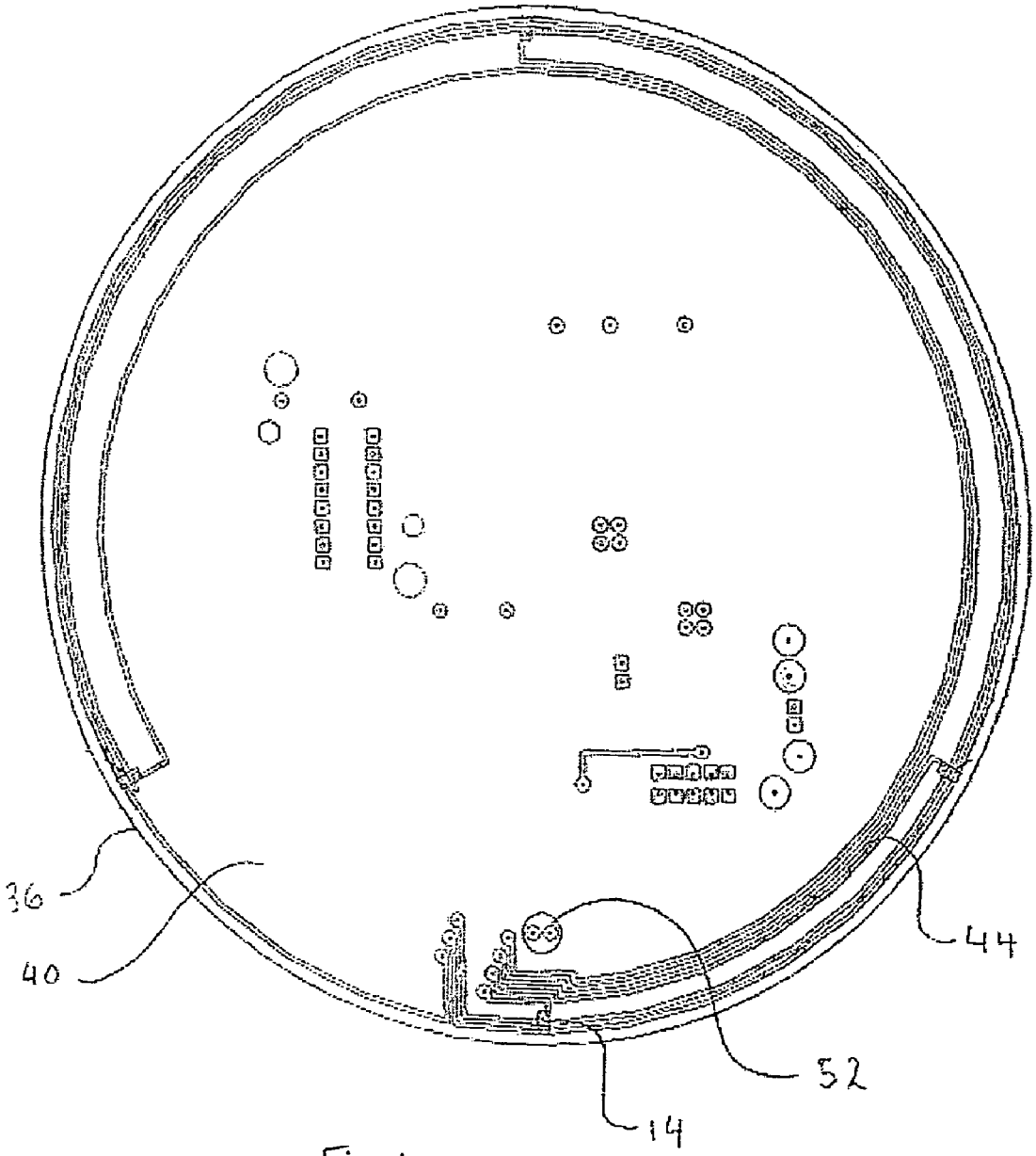
FIG. 6 is a top view of the circuit board.

Referring now to FIGS. 5 and 6, the circuit board 36 is a circular, double sided, standard phenolic circuit board capable of withstanding temperatures in excess of those generated by a cigarette, for example, alone before distorting or experiencing melting of the conductive circuit pathways 44. The circuit board 36 rests on flange 5 of the lower component housing 18 and is held in place by the close tolerance between the upper housing and the vented lower component housing flange 5 and adhesive. The preferred embodiment uses a 25 mm separation between the bottom of the upper housing and the top face of the circuit board 40.

Figure 7:
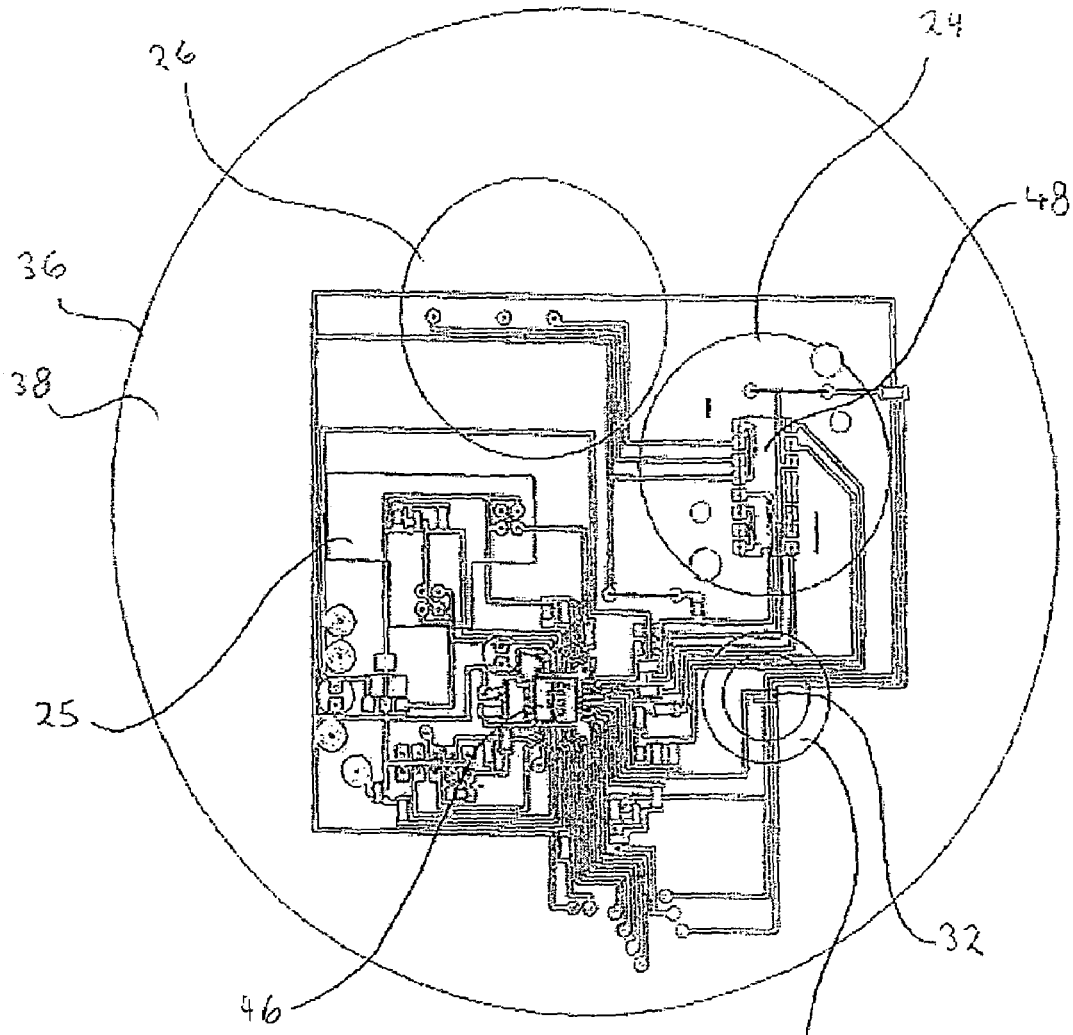
FIG. 7 is a bottom view of the circuit board without a battery installed.

Looking at FIG. 7, a view of the bottom face of the circuit board 38, the general arrangement of the components can be seen. Smoke detector ionization chamber 24 is mounted above smoke detector integrated circuit microchip 48 and adjacent piezoelectric horn 26, and angle alarm optical sensor 32 which is centered above hemispherical cup 34. Microprocessor chip 46 is located approximately centrally on the circuit board 36 and adjacent smoke detector photo sensor 25.

Looking at FIG. 6, a view of the top face of the circuit board 40 the general arrangement of the remaining components can be seen adjacent to LED 52. Conductive circuit pathways 44 can be seen traced about the circuit board 36 connecting the various electrical components.

Figure 4:
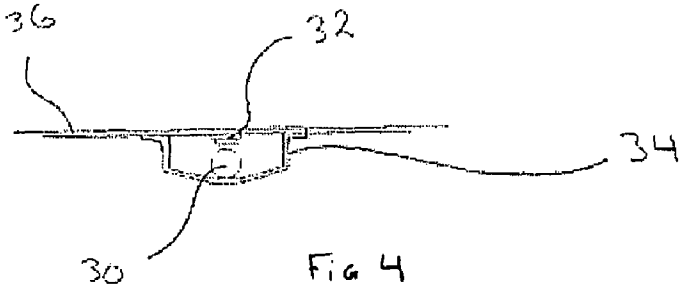
FIG. 4 is a cross sectional view of the angle alarm device.

FIG. 4 shows the ball 30, hemispherical body 34, and angle alarm optical sensor 32 of the angle alarm device, as mounted onto circuit board 36.

To increase the margin of protection afforded to the components and circuit board 36, in the event the unit is placed in an extremely warm environment (I.E. next to a burner, light, heat source, etc.)the main body 2 is constructed from a heat resistant polycarbonate. It is expected that this unit will find use in commercial and industrial environments where it may be located beside processes utilizing high temperatures and prone to initiating fires. Although it is well known that it may be made from any of a plethora of heat resistant polymer such as that trade named Melamine (an organic base with the chemical formula C3H6N6, with the IUPAC name 1,3,5-triazine-2,4,6-triamine.) As additional protection, there is an air filled void 50 between the upper housing 16 and the circuit board 36 and all the components except for the LED light 52, and the override optical sensor 14 reside on the bottom face 38 of the circuit board 36. A thin heat dissipating circular metal foil disk may be optionally placed in the void 50 between the circuit board 36 and the upper housing 16, although it is not utilized in the preferred embodiment.

It is to be noted that the lower component housing 18 is configured with an angular face and a plethora of equally spaced vents 20 thereon as well as orifices on the base 23. The vents 20 extend axially along the housing 18 and onto the outer periphery of the base 23. Experimentation has shown that this is the best physical configuration to draw in warm, smoke laden air into the internal cavity and toward the two smoke sensors. This physical configuration utilizes the principles of the venturi effect (from the angled slots), warm air rising and thermal siphoning or thermal cycling to draw the smokey air into the unit. When smoke is present there will be a temperature gradient across the unit which initiates the drawing action. Since the vents 20 reside below lip 3 of the main body 2, the lip serves to constrain and accumulate warm, smoke laden air momentarily until the full action as described above can occur. The design of the slots 18 extending onto the base 23 also enhances the ventilation draw again utilizing the "warm air rising" principle. There was an unexpected result discovered with this angled slotted configuration, not found with any diameter of similarly situated round or oval orifices—that of an increased draw of smokey air into the unit. Additionally, the base's orifices 21 allow smoke below the unit to be drawn in since the unit's feet 22 allow the orifices to remain open to the atmosphere. In combination these design features enable an enhanced ventilation flow making the unit extremely sensitive in all locations and renders a very fast response time.

Note, the override optical sensor 14 and the angle alarm optical sensor 32 are all identical optical sensors. (These are also commonly referred to as photo sensors.) The smoke detector's responses to single or multiple sensor signals are defined by the logic programed into the microprocessor 26.

Referring to FIG. 5 again, it can be seen that the angle alarm device is made of a angle alarm optical sensor 32, and a hollow hemispherical body 34 with a ball 30 that is free to move within the body 34. This sensor is also a standard discrete infra red matched LED and infra red receiver unit.

The angle alarm optical sensor 32 is mounted directly above the hemispherical body 34 and at the proximate centerline of the body 34 and ball 30 when the smoke detector 1 and angle alarm device is horizontally orientated position. In this manner the ball 30 reflects emitted light back to the angle alarm optical sensor 32 when the smoke detector 1 remains within a specific range of angles. Thereafter, the ball 30 will not be in the path of the emitted infra red light and there will be no back reflection to the sensor 32. Following this logic, severe bumping or rapid movement of the smoke detector 1 will also cause the ball 30 to move away from the path of the emitted infra red light, momentarily eliminating any back reflection to the sensor 32. This presents the user with audible notification if the unit has been knocked from its temporary location and perhaps landed at an elevation or location where the smoke sensing capability is diminished.

The override optical sensor 14 is located below an area on the flange 4 of the upper housing 16. When this override optical sensor 14 is covered, it senses any back reflection of infra red light and sends a signal to the microprocessor 46 which stops generating all audible and visual alarm signals, (including all alarms soon to be initiated by the angle alarm optical sensor 32 if the smoke detector is being tipped), and resets the alarm timers. The override optical sensor 14 thus overrides all audible and visual alarm signals sent by the microprocessor 46. This useful when moving or relocating the unit so as to eliminate an unwanted audible alarm.

Note, that the angle alarm optical sensor 32 elicits responses upon an absence of reflected light within the sensor, while the override optical sensor 14 and the smoke detector photosensor 25 elicit responses based on the detection of infra red light within the sensor. All of these optical/photo sensors are standard discrete infra red matched LED and infra red receiver combination units as are well known in the industry.

A visual alarm light 52 is located adjacent the override optical sensor 14. It is a colored light emitting diode (LED) that is clearly visible through the upper housing 16. It is activated simultaneously by the microprocessor 46 with either the first or second level audible alarm signal.

There are two types of smoke detecting means utilized in the smoke detector 1, a photo sensor smoke detector 25 and an ionization chamber smoke detector 24. Both means sense smoke particles that pass into the vented lower component housing 18 through the vents 20. Since hot smoke rises, the only smoke to enter the lower component housing 18 would be from a smoke source that below the smoke detector 1.

The ionization chamber smoke detector 24 generates a signal which it sends to the smoke detector microchip 48. (The industry standard is used in the preferred embodiment which is a low voltage CMOS integrated circuit Motorola model MC 14467 microchip, although there are other microchips which perform adequately.) This signal increases with the increasing level of smoke detected by the ionization chamber. Once the signal strength increases beyond a certain threshold level as set in the microchip 48, the microchip 48 sends a signal to the microprocessor 46. The microprocessor 46 will then send an alarm signal back to the driver circuit of the microchip 48 to sound the second level (loudest sounding) alarm via the horn 26 and activate the LED 52. (Provided that the override optical sensor 14 is not activated.) The driver circuit of the microchip 48 is used to drive the horn 26 since the microchip 48 has a higher voltage capability than does the microprocessor 46. Thus, the driver circuit on the smoke detector microchip 48 powers the horn 26 but based on a signal input from the microprocessor 46. The microprocessor 46 can send two different signals to be generated by the microchip 48 depending on the desired horn frequency which then determines the corresponding horn sound and volume.

The smoke detector photo sensor 25 is a standard discrete infra red matched LED and infra red receiver positioned in a spaced configuration (approximately ⅜" apart) at right angles to each other on the bottom side of the circuit board 36. Smoke particles moving in the beam path of emitted infra red light from the LED, reflect infra red light onto the receiver. A signal is generated by and sent from the photo sensor 25 directly to the microprocessor 46 (bypassing the smoke detector microchip 48). The signal strength increases with an increasing amount of smoke particles as seen and detected by the photo sensor 25. The microprocessor 46 compares the magnitude of the signal strength through an algorithm to a preset preprogrammed threshold value (that corresponds to a predetermined positive indication of smoke detection). Once this threshold value is exceeded, the microprocessor 46 sends a second level alarm signal to the smoke detector microchip's driver circuit to drive the horn 26 as discussed above, and activates the LED 52. (Provided that the override optical sensor 14 is not activated.) On the detection of smoke from either of the smoke detecting means, the loudest audible alarm or second level alarm, is sounded.

Referring now to the operation of the smoke detector 1, the microprocessor 46 receives information from the following four sources: the battery 42, the override optical sensor 14, the angle alarm optical sensor 32, the smoke detector photo sensor 25, and the smoke detector integrated circuit microchip 48. Based on algorithms programed onto the microprocessor 46, in response to signals from the abovementioned sources, the microprocessor 46 sends one of two different frequency signals to the piezoelectric horn 26 via the smoke detector microchip's driver circuit, resets the internally programed algorithmic countdown timer on the microprocessor, activates a LED light 52, or initiates a rhythmic "chipping" alarm from the horn 26.

The microprocessor 46 used in the preferred embodiment is a Silicon Labs Model 8051 microprocessor, flash programable device, although a plethora of others could be substituted. It has been programed to initiate a first level, second level or battery low alarm signal; to control the tone of the horn 26; to filter and analyze the various sensor inputs; to run the countdown timer; to activate a LED alarm light 52 and it can also vary the threshold smoke detection limit from the smoke detector photo sensor 25 or the threshold smoke detection limit of the smoke detector microchip 48. A power converter is utilized to switch the 9 volt dc power down to approximately 3.3 volts and 25μ amperes to operate the microprocessor 46.

The smoke detector integrated circuit microchip 48 is a low voltage, CMOS, integrated circuit, analogue microchip. The preferred embodiment uses the industry standard Motorola MC 14467 microchip, although substitution of other microchips would render the equivalent performance. The microchip 48 receives a variable signal from the smoke detector ionizing chamber 24 that increases with increasing smoke particle density within the chamber 24. The microchip 48 has a driver circuit on it that powers and sounds the horn 26 in response to the first level alarm signal, the second level alarm signal or the low battery "chirping" signal sent by the microprocessor 46.

The microprocessor 46 generates different audible alarm signals depending upon the algorithmic determination of which level of alarm is to be sounded. There is only one audible alarming device 26 but three distinct audible alarms are emitted. The first level alarm will initiate an intermittent "chirping" alarm a will occur with a low voltage level battery 42 and continue until such time as the battery 42 dies or is replaced. The second level alarm (optional) is a continual audible alarm, initiated in response to an extremely low voltage battery level or an override optical sensor that has been activated for more than a preselected period generally 30 seconds (thus disabling all audible alarms.) The third level alarm is initiated by, a tipped smoke detector 1, or a positive indication of smoke from either of the smoke detector means.

The horn 26 is modulated to control the volume level and the tone. This will affect the resonance of the horn. For the first level alarm a quiet, low frequency signal (one that is not a harmonic of the resonant frequency) is generated. For the second level alarm a high decibel, high frequency signal is emitted. The second level alarm is designed to attract more attention than the first level.

All alarms can be temporarily over ridden by the alarm override sensor 14, logically since it indicates the presence of an awake person until the preselected period (commonly 180 seconds) has been reached. The preselected period time is to prevent the cancellation of the unit's alarm features in the event that an object inadvertently blocks the alarm override sensor 14.

One of the features offered by this unit is the ability for easy testing. All one needs to do to test its function is to tilt it with the alarm override sensor unactivated. (I.E. with no finger covering the sensor area.)

While the unit is primarily intended for use with DC power to enable the portability feature, it is known that it may be connected to AC power through the use of an AC/DC adapter where longer term use is intended.

The actions of the user and/or smoke detector and the responses triggered by the microprocessor are best illustrated by the following chart:

| Action | Microprocessor Activated Response |
|---|---|
| cover alarm override sensor (system alarm override) | initiate override timer<br>mute alarms<br>turn off light |
| tip smoke detector | sound $2^{nd}$ level alarm activate light |
| bump smoke detector | sound $2^{nd}$ level alarm activate light |
| stabilize or put smoke detector horizontal | mute alarm<br>turn off light |
| smoke enters through vents & triggers ionization chamber | sound $3^{rd}$ level alarm activate light |
| smoke clears in ionization chamber | mute alarm<br>turn off light |
| smoke enters through vents & triggers photo cell | sound $3^{rd}$ level alarm activate light |
| smoke clears in photo cell | mute alarm<br>turn off light |

-continued

| Action | Microprocessor Activated Response |
|---|---|
| smoke enters through vents & triggers ionization chamber and photo cell | sound 3rd level alarm activate light |
| smoke clears in ionization chamber or photo cell while other smoke detector still activated | 3rd level alarm remains on light remains on |
| smoke clears in ionization chamber and photo cell | mute alarm turn off light |
| battery voltage level drops below first preset level | intermittent "chipping" alarm sounds and light is activated |
| battery voltage level drops below second preset level | 1st level alarm remains on light remains on |
| battery replaced with new one | mute alarm turn off light |
| battery voltage drops below level to operate unit | alarm cannot sound light cannot come on microprocessors cannot function |

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

Having thus described the invention, what is claimed as new and desired to be secured by Letters Patent is as follows:

1. A microprocessor controlled alarming smoke detector designed to provide an early warning of a potential fire situation comprising:

a two piece main body defining an enclosed cavity, formed from the mating engagement between an upper housing and a vented lower component housing wherein said body is fabricated from an infra red translucent, heat resistant polymer;

an audible alarming device;

a smoke detector ionizing chamber;

a smoke detector photo sensor;

a smoke detector integrated circuit microchip, adapted to send a signal to a microprocessor and to drive said audible alarming device in response to an output alarm signal from said microprocessor;

an angle alarm optical sensor;

an infra red alarm override optical sensor;

a microprocessor, adapted to analyze input signals from said smoke detector microchip, said angle alarm optical sensor, and said infra red override optical sensor, and generate output alarm signals, and reset internal timing circuits, as determined by algorithmic functions programmed into said early warning microprocessor; and a power source;

a circuit board held in spaced configuration within said cavity and is adapted to electronically connect and house all components;

wherein said lower component housing has multiple linear vent slots extending axially along a tapered side and partially onto a bottom surface thereof, and a series of orifices formed through said bottom surface.

2. The microprocessor controlled alarming smoke detector of claim 1 wherein said audible alarming device is a piezoelectric horn.

3. The microprocessor controlled alarming smoke detector of claim 2 wherein said power source is a DC battery.

4. The microprocessor controlled alarming smoke detector of claim 2 wherein said power source is a 120 volt AC source transformed to DC power.

5. The microprocessor controlled alarming smoke detector of claim 4 wherein said infra red override optical sensor is located on said circuit board below and adjacent said planar outer ring.

6. The microprocessor controlled alarming smoke detector of claim 5 wherein said angle alarm optical sensor is comprised of an infra red matched led and infra red receiver affixed to said circuit board and positioned directly above a reflective sphere contained between said circuit board and a hemispherical chamber such that said angle sensitive photo sensor switch detects when said sphere resides in an approximate center of said chamber.

7. The microprocessor controlled alarming smoke detector of claim 6 wherein said smoke detector integrated circuit microchip contains a driver circuit that sends a signal to sound said horn in response to said microprocessor output alarm signal.

8. The microprocessor controlled alarming smoke detector of claim 1 further comprising a visual alarm warning light emitting diode and wherein said microprocessor is further adapted to analyze input signals from said smoke detector microchip, said angle alarm optical sensor, and said second infra red override optical sensor and generate output alarm signals to activate said light emitting diode as determined by algorithmic functions programmed into said microprocessor.

9. A battery powered microprocessor controlled audibly alarming smoke detector having an infra red translucent main body defining an enclosed cavity formed from the mating engagement between an upper housing and a vented lower component housing, wherein said microprocessor controlled audibly alarming smoke detector comprises the following components:

at least one smoke sensing device;

a tipped smoke detector sensing device;

a tipped smoke detector sensing override device;

an audible alarming device; and a microprocessing means adapted to initiate said audible alarming device according to a programmed algorithmic logic in response to signals generated from said smoke sensing device, said tipped smoke detector sensing device and said tipped smoke detector sensing override device;

wherein said lower component housing has multiple linear vent slots extending axially along a tapered side and partially onto a bottom surface thereof, and a series of orifices formed through said bottom surface.

10. The microprocessor controlled alarming smoke detector of claim 9 further comprising a circuit board adapted to hold all components in a spaced configuration within said enclosed cavity.

11. The microprocessor controlled alarming smoke detector of claim 10 wherein said smoke sensing device is comprised of a smoke detector integrated circuit microchip adapted to receive signals from at least one said smoke detector means and generate signals to said microprocessor in response to the detection of smoke from said smoke detector means.

12. The microprocessor controlled alarming smoke detector of claim 11 wherein said tipped smoke detector sensing device is an infra red matched light emitting diode and infra red receiver positioned on said circuit board adjacent and above an unconstrained sphere in a hemispherical race such that tipping of said smoke detector causes said sphere to move such that there is no infra red light reflectance from said sphere onto said receiver.

13. The microprocessor controlled alarming smoke detector of claim 12 wherein said a tipped smoke detector sensing override device is an infra red matched light emitting diode and infra red receiver positioned on said circuit board below, adjacent and in close proximity to said upper housing such that detection of a user's digit on said upper housing is facilitated by infra red light reflectance.

14. The microprocessor controlled alarming smoke detector of claim 13 further comprising a light emitting diode adapted to activate upon the generation of an alarm signal from said microprocessor.

* * * * *